US006128090A

United States Patent [19]

hunsel et al.

[11] Patent Number: 6,128,090

[45] Date of Patent: Oct. 3, 2000

[54] VISUAL CONTROL STRIP FOR IMAGEABLE MEDIA

[75] Inventors: Johan Van hunsel, Alken; Jan Van Cauwenberge, Wichelen, both of Belgium

[73] Assignee: Agfa Gevaert N.V., Mortsel, Belgium

[21] Appl. No.: 08/987,968

[22] Filed: Dec. 10, 1997

Related U.S. Application Data

[60] Provisional application No. 60/039,707, Feb. 13, 1997.

[30] Foreign Application Priority Data

Dec. 11, 1996 [EP] European Pat. Off. ..... 96203475

[51] Int. Cl.[7] ..... G01J 3/46; G01N 21/25; B32B 7/02; G03C 5/00

[52] U.S. Cl. ..... 356/402; 356/243.5; 356/408; 356/443; 356/404; 347/131; 428/212; 430/30

[58] Field of Search ..... 347/131; 428/212; 356/443, 243.5, 402, 404, 408; 355/77

[56] References Cited

U.S. PATENT DOCUMENTS

| | | | |
|---|---|---|---|
| 4,004,923 | 1/1977 | Hensel . | |
| 4,183,990 | 1/1980 | Uchida et al. | 428/212 |
| 4,310,248 | 1/1982 | Meredith | 356/402 |
| 4,419,426 | 12/1983 | Kehl | 356/443 |
| 4,504,141 | 3/1985 | Yamakoshi | 355/77 |
| 4,588,298 | 5/1986 | Nakamura | 356/443 |
| 4,852,485 | 8/1989 | Brunner | 101/121 |
| 5,031,534 | 7/1991 | Brunner | 101/365 |
| 5,493,321 | 2/1996 | Zwaldo | 347/131 |
| 5,636,330 | 6/1997 | Barak . | |

FOREIGN PATENT DOCUMENTS

| | | |
|---|---|---|
| 0518559 | 6/1992 | European Pat. Off. . |
| 2206568 | 5/1974 | France . |
| 681929A5 | 6/1993 | Switzerland . |

OTHER PUBLICATIONS

The URGA/FORGA Digital Control Wedge and its Application. By Dr. K. Munger.

The URGA/FORGA Postscript Control Strip in Practical Use Part 2. By U. Schmitt Fogra Mitt. vol. 43, No. 148 Aug. 1994, pp.–22–24.

*Primary Examiner*—Frank G. Font
*Assistant Examiner*—Roy M. Punnoose
*Attorney, Agent, or Firm*—John A. Merecki; Edward L. Kelley

[57] ABSTRACT

A visual control strip for imageable media such as a printing plate, a photographic film or a printable substrate is described wherein the visual control strip is to be applied to the imageable medium. The control strip includes a plurality of first control fields having differing grey tone values which are relatively insensitive to the processing variables which influence the size of the spots or dots produced on the imaged medium. The control strip also includes at least one second control field which is relatively sensitive to these process variables. The second control field is located immediately adjacent to the first insensitive control fields for ease of comparison. The second sensitive control field has a target grey tone value which may typically be 25%, 50% or 75%. To improve assessment of exposure parameters, the insensitive fields are completely surrounded by a sensitive field or vice versa.

Methods of using the strip are also described for both traditional or photomechanical and digital reproduction methods.

26 Claims, 8 Drawing Sheets

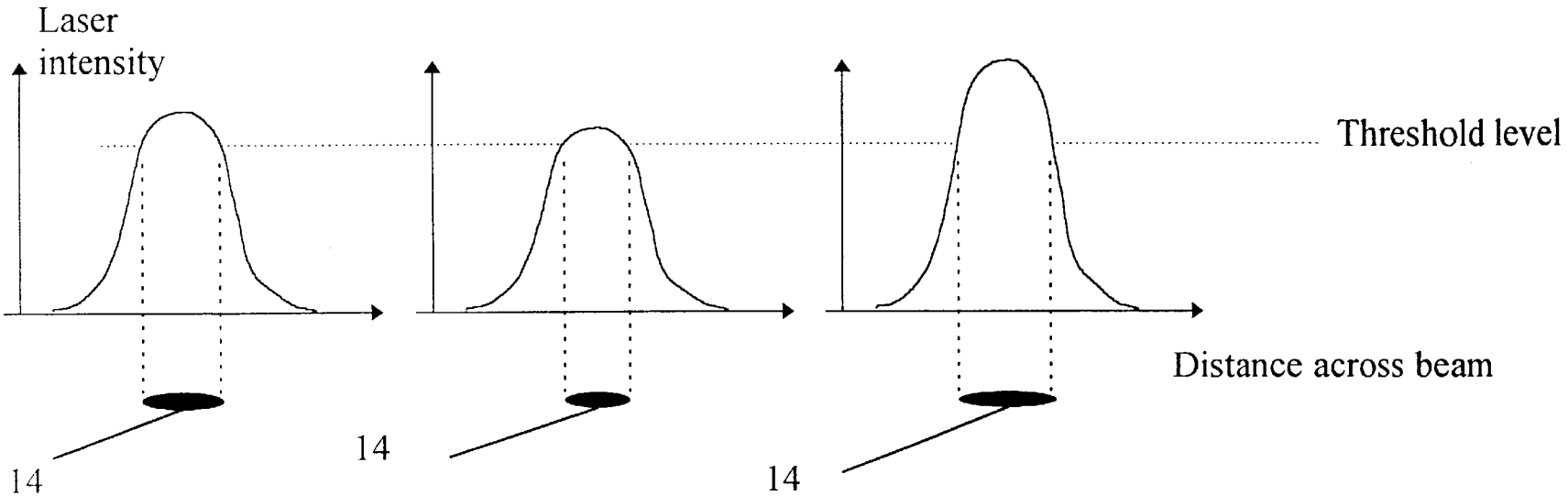
Fig. 2A
Fig. 2B
Fig. 2C
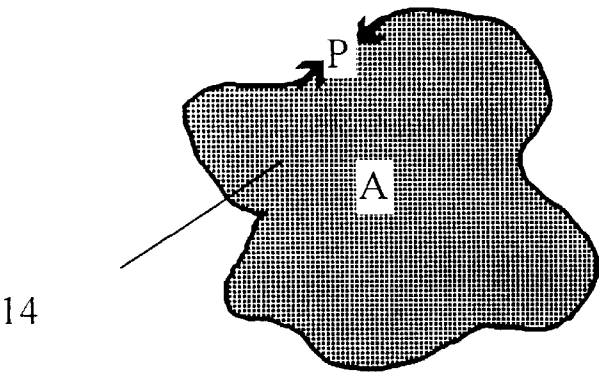
Fig. 2D

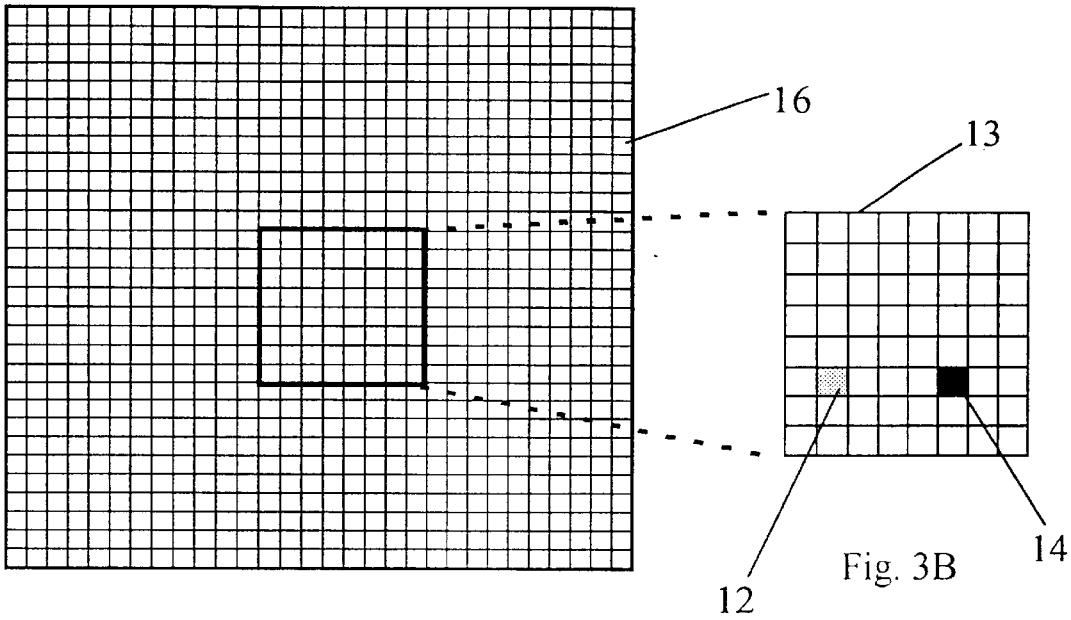
Fig. 3A
Fig. 3B
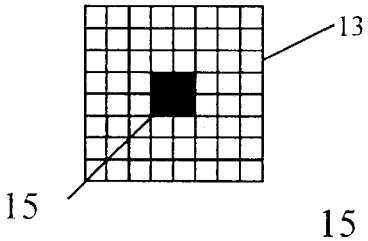
Fig. 3C
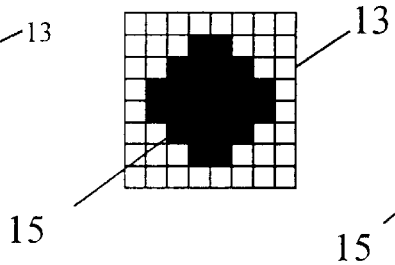
Fig. 3D
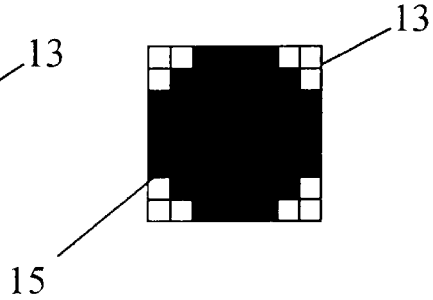
Fig. 3E
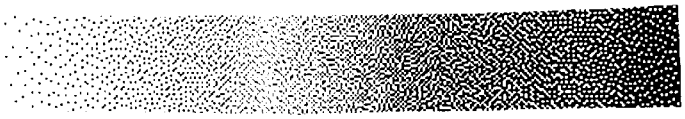
Fig 4A
| | | | | | | | |
|---|---|---|---|---|---|---|---|
| 1 | 17 | 5 | 21 | 2 | 18 | 6 | 22 |
| 25 | 9 | 29 | 13 | 26 | 10 | 30 | 14 |
| 7 | 23 | 3 | 19 | 8 | 24 | 4 | 20 |
| 31 | 15 | 27 | 11 | 32 | 16 | 28 | 12 |
13
Fig. 4B

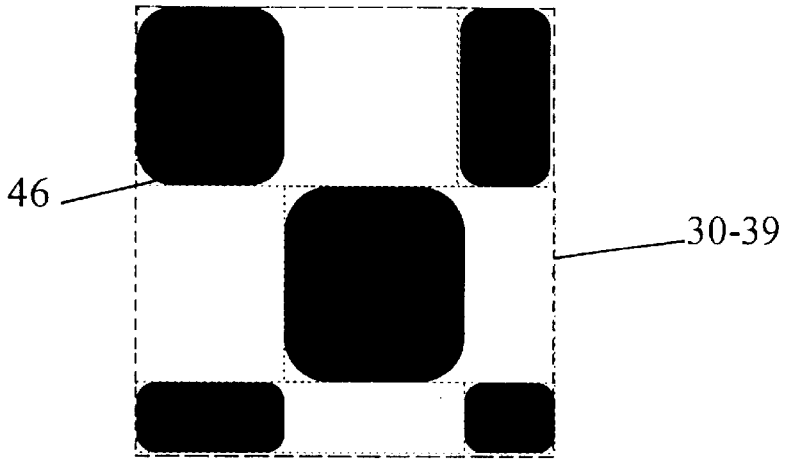
Fig. 9
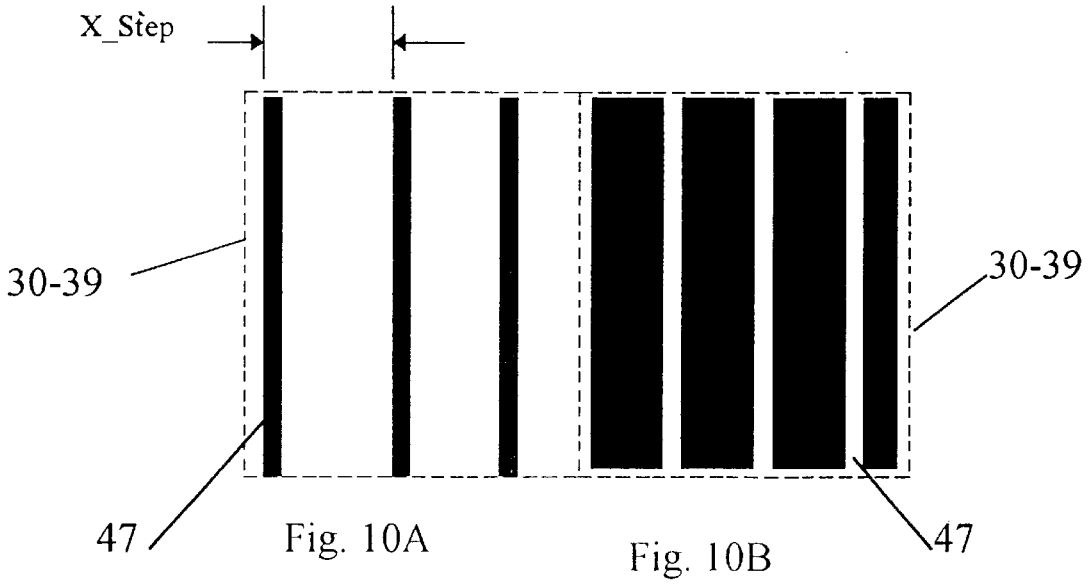
Fig. 10A
Fig. 10B
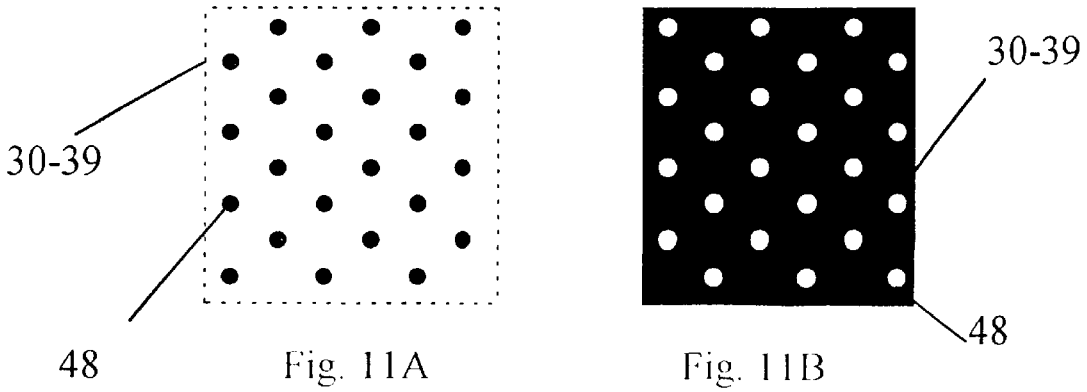
Fig. 11A
Fig. 11B

VISUAL CONTROL STRIP FOR IMAGEABLE MEDIA

This application claims benefit of Provisional Appl. 60/039,707 filed Feb. 13, 1997.

FIELD OF THE INVENTION

The present invention relates to devices and methods for imaging substrates as well as the substrates themselves. In particular the present invention relates to methods and devices for exposure and development of imageable media including photographic film and printing plates. The present invention also includes devices and methods for printing and the printed substrate. More specifically the present invention relates to a visual control strip suitable for quality control of imaging devices and imaged media.

BACKGROUND OF THE INVENTION

Several types of control strips are known. As described in U.S. Pat. No. 4,852,485, analogue control strips have been used, which consist of a piece of patterned film which could be attached onto a lithographic film before contacting it to a printing plate.

CH-A-0 681 929 describes a test "wedge" or control strip which is stored as a digital quantity on a storage medium such as a "floppy disk" or in a computer and is incorporated herein by reference. The control strip consists of a variety of control fields. Each control field contains a pattern, e.g. a star target, types, a line series, which may contain elements, e.g. checkerboard squares, lines or dots.

EP-A-0 518 559 describes a method and apparatus for creating a control strip. A digital representation of the control strip is printed to form a visible, analogue representation of the control strip. The control strip may be printed at the same time as a main coloured image to be reproduced. The control strip consists of control fields and the elements of the control fields can be user defined.

Postscript™ is a programming language created by Adobe Systems Inc., California, USA for defining page, lettering, colour and graphics parameters of images to be output by a raster imaging device such as a printer, an imagesetter or a platesetter. PostScript™ is described in the "PostScript Language Reference Manual", second edition, Addison-Wesley, 1990 (hereinafter referred to as "AdobeRef") and incorporated herein by reference. PostScript™ files may be incorporated in the file for a main image as an encapsulated PostScript file (EPS file), as described in Appendix H, pages 709–736 in AdobeRef.

The general techniques of colour reproduction, e.g. printing, photographic films, display devices, are described in "The Reproduction of Colour in Photography, Printing and Television", by Dr. W. G. Hunt, Fountain Press, UK, 1987 (referred to in the following as "KodakRef"). The Kodak "Three-Aim-Point" method is known from this book for producing printing plates that will yield results having consistent tone reproduction and colour balance despite Image Spot Size Deviation Variables (ISSDV) inherent in any system of image production or reproduction. One such variable or parameter is the development time for photographic film. So-called "hard dot" photographic films, such as Kodak Imageset 2000 IHN™ and imageset 2000 ILD™, are very sensitive to the development time period. If this period is short, then small spots are formed. If this period is longer, then larger spots or spots having a bigger area are formed. In several systems, such as in direct thermal systems, development is not required. In direct thermal systems, the size or the area of each spot may be influenced by the amount of energy applied to a specific microdot. Thus in such a system, one ISSDV is the amount of thermal energy locally applied.

Standard "originals" are provided in the form of three neutral density (grey) patches : original "A" represents a minimum reproducible density in an average transparency or reflection print, patch "B" is a similar maximum density patch, and patch "M" is a similar medium density patch. When the photographic material is processed, the patches are located next to the useful image and processed with it. As a result of experience, standard values and tolerances have been determined for the densities produced by the patches A, B and M on typical masks and separation negatives.

DE-A-19 507 665 discloses a control strip for visual control consisting of two adjacent longitudinal fields. The first field has large elements, the size of which is substantially independent from illumination variations. The target density of the large elements is position dependent. The second field has fine elements, having substantially the same tone value. The effective tone value depends strongly on the illumination conditions. Although it is possible to assess important illumination variations by this method, it is—due to the arrangement of the different fields—rather difficult to assess accurately small variations in process parameters and to get a quantitative measure for curing the effect.

OBJECTS OF THE INVENTION

It is an object of the present invention to provide a method and apparatus to control marking of an imageable medium and/or to control the imaging device to produce images of the correct density.

It is a further object of the present invention to simplify calibration or routine control of the image quality of imaging devices and imaged media.

In particular, it is an object of the present invention to provide a means to assess and control the exposure of imaging devices and imaged media.

It is still a further object of the present invention to reduce waste of imaged materials in the set-up/proofing stage of the reproduction of colour and black and white images.

It is yet another object of the present invention to improve the reliability of calibration or routine control of the image quality of imaging devices and imaged media and to make this control less operator sensitive.

It is a further object of the present invention to optimise the size of a visual control strip while maintaining functionality as a quality control instrument.

SUMMARY OF THE INVENTION

The above objects are realised by the specific features according to claim 1. Specific features of preferred embodiments are set out in the dependent claims.

The visual control strip according to the present invention is preferably described as a set of PostScript™ commands but the invention is not limited thereto. This gives the freedom to incorporate the strip in many printing applications such as computer-to-plate and computer-to-film applications. This strip may even be used in the last stage of making a printing plate or film.

In a preferred embodiment the visual control strip in accordance with the present invention is placed at a location on the imageable medium which is imagewise functionally irrelevant. For instance, it may be placed on a printing plate at a location which remains ink-free during the subsequent printing process.

The present invention also includes a set of visual control strips wherein the target values of the ISSDV (Image Spot Size Deviation Variables) sensitive control fields of the respective strips differ from each other. Advantageously, three strips may be used with target values for the sensitive fields of 25%, 50% and 75%, respectively.

The present invention also includes an imaged medium and a method of assessing imaging quality.

Further objects, advantages and embodiments of the present invention will become apparent from the following description and drawings.

BRIEF DESCRIPTION OF THE DRAWINGS

FIGS. 2A to 2C show the effect of laser intensity on spot size in a digital imager.

FIG. 2D represents a spot or cluster of spots on an imaged medium.

FIGS. 3A to 3E show the formation of halftone dots in a typical amplitude modulated screening method.

FIG. 4A shows a typical conventional frequency modulated grey tone scale with randomised spots.

FIG. 4B shows the sequence of spot filling in the halftone cell of a conventional quasi-random screening method.

FIG. 9 shows a checkerboard field in accordance with the present invention.

FIGS. 10A and 10B show pixel line fields in accordance with the present invention.

FIGS. 11A and 11B show raster fields in accordance with the present invention.

DEFINITIONS

Figure 1:
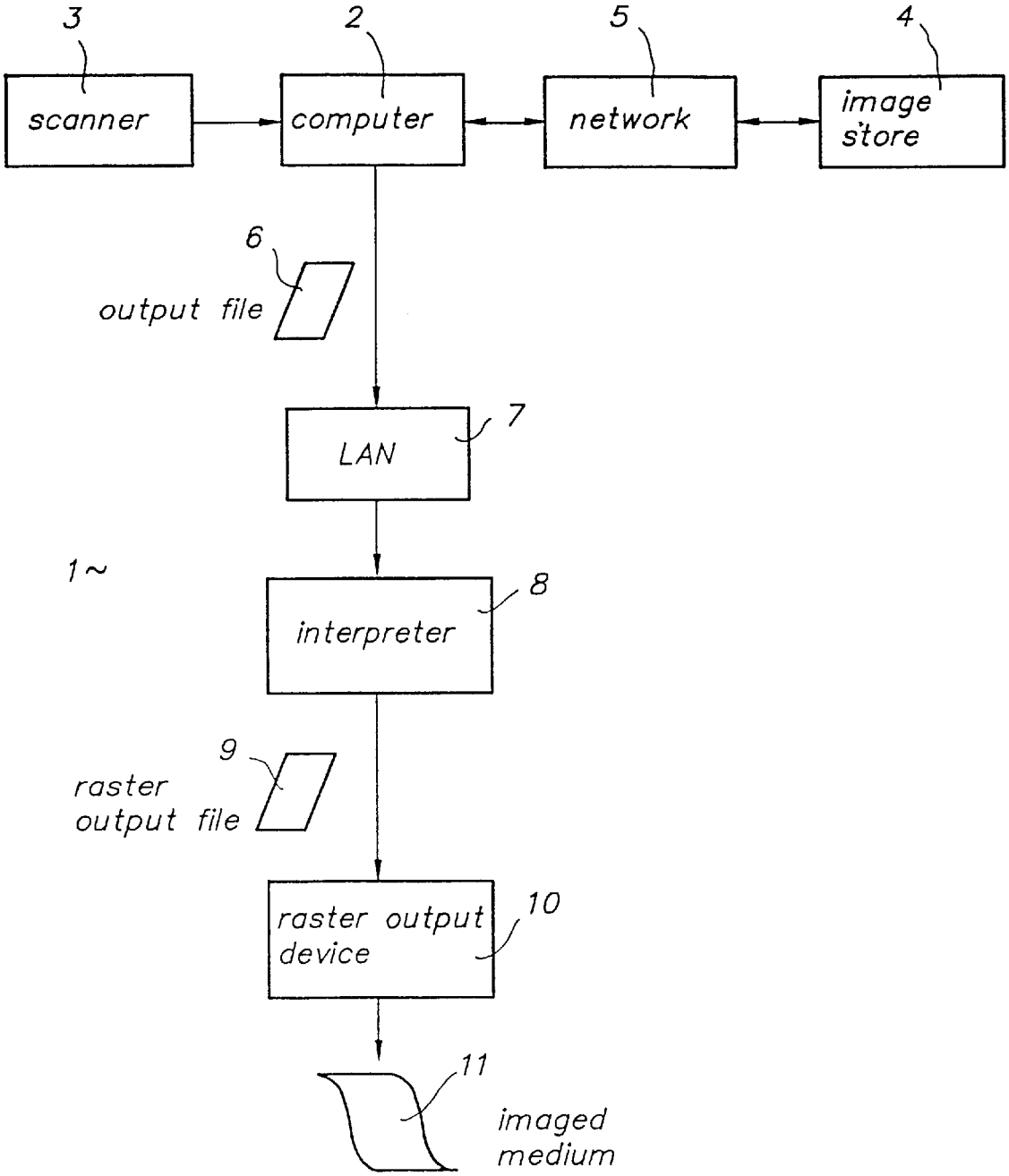
FIG. 1 (PRIOR ART)
FIG. 1 shows a schematic block diagram of a digital imaging process in accordance with the present invention.

"Useful image" in accordance with the present invention refers to the image which is to be recorded on an imageable medium excluding any other images which may be used for control of the imaging process.

A "microdot" in accordance with the present invention describes the smallest addressable spatial unit, i.e. portion, of a substrate or medium which can be addressed by an imaging device in order to cause a density change in that unit. A microdot may have any suitable shape such as square, round elliptical etc.

In this description, often "density" is referred to. In the context of material for visual control, "optical density" is meant. This may be optical density for transmission or reflection of light. The light may be white light or monochrome or monochromatic light. The "light" may also be UV-light or infrared light. Alternatively, by "density" may be meant "lithographic effective" or "ineffective". By this is meant ink accepting or ink repellant.

A "spot" in accordance with the present invention is the smallest actual image which can be produced on an imageable medium by an imaging device. A spot is the result of "rendering" or "marking" a microdot on the medium. In a photographic system, a spot is marked by illuminating a portion of the photographic substrate by a suitable amount of light. A spot produced on a photographic substrate is a developed spot. Depending on the type of the photographic material, a black or white spot is formed, or, more generally, a spot having a high or low optical density (for reflection or for transmission of light) is formed and/or an ink accepting or an ink repellant spot is formed. The spot produced on a printed substrate is a printed spot. A spot may have any suitable shape such as square, round or elliptical. Usually the centre of a spot has the same location as the centre of a microdot. Each microdot may contain usually one spot. A spot may be larger than its corresponding microdot, i.e. fully cover it, along with portions of neighbouring microdots. A spot may be smaller than its corresponding microdot, i.e. cover only a portion of the microdot. A spot may also partly overlap the corresponding microdot and partly overlap neighbouring microdots. This is for example the case if the microdots are square and the spots are circular, where the area of the spot equals the area of the microdot and the centre of the spot coincides with the centre of the microdot. A microdot may be left "empty", i.e. no spot is placed in the microdot. Whereas the microdot is a fictive area, a spot has a lower density, with respect to its neighbourhood. Alternatively, a spot may have a high density, with respect to its neighbourhood. On a lithographic printing plate precursor, a spot may give a lithographic effective change. Alternatively, a spot may give a lithographic ineffective change. On a lithographic printing plate, a spot may ink accetable. Alternatively, a spot is ink repellant. A spot may also have a specific "UV-density" with respect to its neighbourhood. In fact, in contact systems, using UV light sources, it is the "UV-density"—and not the traditional "visual density"—of the spots on the contact film which is important. In a positive working system, a "light spot" is formed when the corresponding location has been irradiated. In a negative working system, a "black spot" is formed when the corresponding location has been irradiated. Light and dark may be replaced by "lithographic effective" or "lithographic ineffective" respectively.

A "dot" in accordance with the present invention is just one spot or a cluster of spots on the imaged medium. A particular type of dot is the "halftone" dot which is a dot including a variable number of spots. The variation of size of the halftone dots is used to reproduce "halftones", i.e. intermediate grey tones between white and black.

A halftone dot is formed by just one or a cluster of spots, or by a cluster of absent spots. If the spots are black and the density of the area is low, black spots are clustered in small halftone dots or sparsely distributed halftone dots on a "white" background. For black spots and an area having a high density, the black background is formed by black spots. The halftone dots are the small or sparsely distributed white areas. In that case, the halftone dots are formed by clusters of "non-spots".

The size of the halftone dots and/or the distance between neighbouring halftone dots depends upon the grey tone value for the area in which these halftone dots appear. For dot-size modulation screening techniques using a periodic grid of halftone dots, the size of the halftone dots depends on the required grey tone value. For stochastic screening or frequency-modulated halftoning, wherein the distance between halftone dots is varied, rather than their size, the distance between halftone dots depends on the required grey tone value.

Since usually each microdot may contain at most one spot, it is clear that a halftone dot may also be defined as a cluster of microdots.

"Image Spot Size Deviation Variables" (ISSDV) in accordance with the present invention refers to those imaging process variables which influence the size of the spots of the image formed on the imaged medium and which make the spot size deviate from the desired size. It will be understood that the ISSDV also affect dot sizes as each dot may be made up of one or a plurality of spots. However, the influence of the ISSDV on dot size may depend upon dot design and may be considerably different than the influence on a single spot.

DETAILED DESCRIPTION OF THE INVENTION

In the following the present invention will be described with respect to certain specific embodiments but the present invention is not limited thereto but only by the claims. In particular, the present invention will be described for convenience with reference to the Adobe PostScript™ programming language and to the drawings but the invention is not limited thereto.

General methods of imaging suitable media may be either analogue, e.g. contact film, or digital. One type of digital method and apparatus is described in EP-A-0 518 559 but the present invention is not limited thereto. FIG. 1 is a schematic block diagram of such a system 1. A computer 2 or similar device is used to create a digital representation of an image optionally using a scanner 3 to scan in an image or a store 4 of pre-recorded images which may be accessible optionally via a network 5 such as the Internet. Digital representations of images may be created by graphics software such as Quark XPress™, Adobe PhotoShop™, Adobe Illustrator™, Aldus™ Pagemaker™, Corel Draw™ or similar. The digital representation is preferably stored as an output file 6 in a graphics software and output device independent programming language such as PostScript™. The present invention is not limited thereto. The output file 6 is transferred to a raster imaging device 10 such as an imagesetter, optionally via a LAN or network 7. In a raster imaging device the image is created line by line, i.e. in a raster. Either in the raster imaging device 10 or elsewhere, an interpreter 8 is provided for conversion (raster image processing) of the output file 6 into an imaging device specific raster data file 9 which can be processed by the raster imaging device 10 by scan conversion. It is understood that the raster imaging device 10 may include further separate or integrated devices necessary for the development of the imageable medium, e.g. the processor may contain developing and fixing compartments for the photographic film or printing plate. The output of the raster imaging device 10 is an imaged medium 11, e.g. a photographic film or a printing plate. The imaging system 1 may be a computer-to-plate system.

An example of a suitable raster imaging device 10 may be a Creo PlateMaster controller linked to a Creo 3244 platesetter with plate conveyor, plate processor and plate stacker all supplied by Creo Products Inc. Burnaby, B.C., Canada. The interpreter 8 may include a Creo Allegro RIP station supplied by the same company compatible with PostScript™ Level 2. Suitable imageable media may be N90A printing plates provided by Agfa-Gevaert AG, Wiesbaden, Germany or Lithostar LAP-0 printing plates supplied by Agfa-Gevaert N.V., Mortsel, Belgium. The printing plates may be based on a thin metal sheet such as electrochemically roughened and anodized aluminium (most common plate thicknesses are 6 mil, 8 mil and 12 mil, i.e. respectively 0.15 mm, 0.20 mm, 0.30 mm) or have a polymeric base such as polyester. For colour printing it is usual to provide a set of colour separated printing plates, e.g. cyan, yellow, magenta or cyan, yellow, magenta and black. In accordance with the present invention the same control strip may be used independent of the colour to be used with the printing plate.

A further suitable raster imaging device 10 may be a printer such as an ink jet, thermal transfer or electrostatic printer. Examples are: a DesignJet™ 750C supplied by Hewlett-Packard Corp., USA ; a Summachrome™ Imaging system supplied by Summagraphics Inc., USA ; or a Chromapress™ system supplied by Agfa-Gevaert, N.V., Mortsel, Belgium.

A suitable raster imaging device 10 also may be an imager for photographic film such as the SelectSet Avantra 44™ supplied by Bayer Inc., Agfa Division, Wilmington, USA.

Imaging devices 10 may be calibrated in accordance with the relevant manufacturer's instructions at regular intervals. Such complex procedures are not suitable for routine production control of imaging quality. The visual control strip in accordance with the present invention has been designed to provide rapid, direct and reliable routine control of imaging quality which can be carried out by untrained personnel. In the case of printing plates, the control in accordance with the present invention may be carried out preferably before the actual printing using the plate starts, while taking up the minimum of space on the imaged substrate.

Continuous tone images cannot be represented or reproduced easily by digital devices. Conventionally an image is "screened", i.e. converted into an array of dots of variable size or variable spatial frequency. These dots are small enough that the human eye sees them not as individual dots but as areas of different tones. A typical conventional digital raster imaging device 10 records an image on the imageable medium 11 in accordance with a Cartesian array of elements of the image. In accordance with the present invention a microdot or pixel is the smallest addressable spatial unit on the imageable medium 11 of the Cartesian addressing system of the imaging device 10. For a printer, imagesetter or platesetter, it is the fundamental spatial unit which makes up all other graphical structures such as lines or coloured areas. For output devices, microdots are also called device pixels or RELs (Recorder Elements). Wren the digital raster imaging device 10 is an imagesetter, it creates an image on medium 11 which after development consists of an array of black, white or coloured spots. If the imageable medium 11 forms a lithographic printing plate, the developed spot on the imageable medium 11 is either ink receptive or ink repellent. When the printing plate is used to print the final image, this final image consists of printed spots, each printed spot corresponding to a developed spot on the medium 11.

With negative working imageable media 11, such as computer to film, the developed spot on the imaged medium 11 representing one microdot has a high optical density when illuminated by light, i.e. typically black spots for white light as is well known for so-called "negatives" produced by a conventional camera. In the case where contact films are produced by making use of UV-light (Ultra-Violet) the density is a density for spectral UV-light. For a negative working computer-to-plate system, illuminated zones usually become ink-accepting after optional development and fixing.

For positive working material, the optical density of the spot is low when illuminated by light. For a positive working computer-to-plate system, the illuminated regions become usually ink-repellant.

A typical dimension for a microdot on a 400 dpi (dots per inch) printer is 63.5 $\mu$m, and 7 $\mu$m on a 3,600 dpi imagesetter. This means that for a resolution of 3,600 dpi, the imagesetter 10 addresses about 20,000 microdots per $mm^2$ on the image medium. The present invention is not limited to a certain type of imageable substrate. The spots may be produced by any suitable means, e.g. by heat onto thermally sensitive substrates, by UV or visible or infra-red light onto photosensitive substrates, by application of powders, liquids, inks, pigments or other substances to an appropriate substrate.

For example, in the art both heat mode and photo mode systems are known. In photo mode materials, the image forming reaction is initiated directly by photons having a specific wave length. In heat mode materials, the image forming reaction is initiated by heat. This heat may be applied directly like in direct thermal printing systems. Alternatively, the heat is applied indirectly via transformation of photons to heat, e.g. via infrared absorbing dyes. This may be achieved by imagesetters having high power infrared laser sources, e.g. from 830 to 1064 nanometer.

Usually, the imaging device is capable to form one spot on each microdot. The actual size of a spot on a microdot on the imaged medium 11 may vary from the specified size of the microdot depending upon the settings of the imaging device 10 and the nature of the imageable medium. For instance, where the imageable medium 11 is a photographic film, the actual size of the developed spot may depend not only on the exposure and development times but also on the sensitivity and properties of the imageable medium 11. For convenience, the invention will be described in the following with reference to an imageable medium 11 on which are produced black spots but the invention is not limited thereto. In particular the present invention will be described with reference to an imageable medium 11 for use in an imagesetter 10.

As shown in FIGS. 2A to 2C schematically, the light intensity of the laser beam used in imager 10 varies across its diameter. The intensity of the laser beam reduces towards the outer parts of the laser beam. Typically the light intensity distribution is Gaussian across a circular beam. Each photographic film or plate has a minimum light intensity or threshold value required to create a spot or an image. In FIGS. 2A to 2C, the developed spot 14 produced by the laser beam of an imagesetter 10 on an imageable medium 11 is shown black but the invention is not limited thereto, the actual developed spot may be in the complementary colour (negative working material) or in the same colour (positive working material) as the colour of the illuminating light. The spot may also be either lithographic effective or ineffective, e.g. ink accepting or ink repellant.

If the energy of the laser is varied keeping the laser beam diameter constant, the actual spot size 14 on the imaged medium after development alters. With less beam energy the spot size is smaller: compare FIG. 2B with FIG. 2A; with more energy the spot size increases: compare FIG. 2C with FIG. 2A. The size of the actual spot 14 on the developed medium and hence the grey tone value of each part of the printed image produced there from is dependent upon the exposure parameters, e.g. The sensitivity of the photographic material, exposure intensity and time duration of the laser beam and the developing process used.

Where the imaging device 10 is a printer, the printed spot size may differ from the desired microdot size and may depend upon the type of inks used as well as the characteristics of the printed substrate. For example, the printed spot size may depend upon dot gain. Dot-gain is related to spreading of the ink when a dot is printed onto a printing substrate. If this spreading is more than anticipated, the effect of the resulting oversize printed dots is to produce an image with a greater image density than would be expected from the size of the developed spots on the printing substrate. The major factors affecting dot-gain are the thickness of the ink layer on the printing substrate, the physical properties of the ink such as its viscosity and the nature of the substrate surface, e.g. whether it is glossy or matt.

Summarising the above, there are a large number of factors which may influence the appearance, in particular the depth of colour, grey tone value or density of the final image on the imageable medium 11. In accordance with the present invention, the set of variables which cause the actual spot size generated on the imaged medium 11 to deviate from the specified spot size will be called the Image Spot Size Deviation Variables (ISSDV). It should be understood that, in accordance with this invention, the term Image Spot Size Deviation Variables include the factors mentioned above which may cause variations in image density or spot size because of changes in exposure conditions in an imagesetter, changes in the printing substrate or printing ink in a printer or the different exposure conditions, photographic substrates and developing methods used in photographic reproduction as well as any other variables which affect the image density of a final or intermediate image.

One conventional screening or halftoning method consists of grouping the developed or printed spots 14 into halftone dots. A halftone dot is provided by the presence or absence of an array or cluster of developed or printed spots contained within a halftone cell. The halftone cells may themselves be part of a larger organisational unit called a "supercell". It is sufficient to describe a simple halftone dot with reference to FIGS. 3A to 3E. FIG. 3A shows a Cartesian array 16 of microdots representing a part of an image to be recorded on imageable medium 11. Where the imaging device 10 is an imagesetter, it is pre-programmed to illuminate each of the individual square elements 12 (i.e. to produce spots 14) in the array 16 or to leave it unexposed in accordance with the requirements of the image to be produced. The imager traverses the array 16 line-by-line or column-by-column. The direction of traverse is known as the fast-scan direction and the direction perpendicular thereto the cross-scan direction. If the imaging device is a printer, it is adapted to print a printed spot 14 in each of the square elements 12 or to leave it blank depending upon the image to be printed. In the following we will describe the invention with respect to an imagesetter but the invention is not limited thereto. Similar principles also apply when the imaging device 10 is a printer or other digital imaging device.

Each 8×8 matrix of microdots 12 shown in FIGS. 3B to 3E is organised as a halftone cell 13. The portion of the original image that is represented by a given halftone cell 13 has a certain spatially integrated grey tone value. To achieve the required grey scale value in the final print, the relevant microdots 12 of the corresponding cell 13 on the imageable medium 11 are illuminated with the laser light so as to create the right number of spots 14 to produce the right grey tone value, e.g. a light tone such as shown in FIG. 3C, a darker tone such as in FIG. 3D or nearly black as in FIG. 3E. The "dot percentage" is given by the ratio of:

the area of the microdots 14 to be illuminated to form spots, to the complete area of the halftone cell 13.

After development, a medium 11 illuminated with a given dot percentage will produce an image of a certain grey tone value which may also be represented by a percentage grey tone value between 0% (white) and 100% (black). If the imaged medium 11 is a printing plate, the plate will print a grey tone value which is related to the dot percentage but will vary in absolute grey tone value depending upon the printing technique used and the printing conditions. Printing may be done by lithography, gravure, flexography and screen printing. The spots 14 in the halftone cells 13 of FIGS. 3C to 3E are clustered together to form a halftone dot 15. The apparent variation in the size of halftone dots 15 is achieved by forming clusters of fixed size spots 14, the size of the clusters increasing with increasing grey tone value. The size of the halftone dot 15 is therefore spatially modulated, i.e. The dot 15 is "amplitude modulated" (AM). This type of screening is referred to as autotypical if adjacent halftone dots 15 are arranged linearly having a screen angle and the mid-points of the halftone dots 15 are spaced by a fixed period. Typical AM screening methods are the Agfa Balanced Screening (ABS) technology supplied by Agfa-Gevaert, N.V., Mortsel, Belgium disclosed in U.S. Pat. No. 5,155,599 and HQS Screening™ and RT Screening™ licensed to Adobe Systems Inc. USA by Linotype-Hell AG, Germany.

If ABS is used with a 45° screen angle, an imaginary line joining two corresponding spots in two neighbouring cells lies at 45° to the vertical axis of the cell, this angle being known as the screen angle. If the cell size is 11×11=121 microdots, the distance in output device space between two such imaginary lines is given by $11\sqrt{2}=15.6$ microdots.

The frequency of such lines, expressed in lines per inch, is called the screen ruling. The screen ruling is dependent upon the resolution of the output device 10. For an output device 10 with a microdot resolution of 2400 dpi, the screen ruling achieved by using such cells is 2,400/15.6=154 lines per inch. By varying the number of microdots within each halftone cell 13, the screen ruling may be altered.

An alternative screening or halftoning method is the stochastic or frequency modulated (FM) method for representing grey tones by binary output systems. In this method it is the number of fixed-sized halftone dots in a particular area which determines the grey value, i.e. The spatial frequency of the halftone dots determines the grey value. The distribution of dots is random or quasi-random as shown in FIG. 4A and they are not organised into touching clusters except by chance when the grey tone value approaches mid-grey to black values. The number of fixed-sized dots in a particular area may determine the grey tone value, wherein each dot may include several spots. An example of a frequency modulated screening method is the Cristal-Raster™ technology provided by Agfa-Gevaert, N.V., Mortsel, Belgium.

A suitable FM screening method in accordance with the present invention may be quasi-random. For example, as suggested by B. E. Bayer in the article "An optimum method for two-level rendition of continuous tone pictures", Proc. IEEE, Int. Communication Conference, Vol. 26, pp 11–15, 1973, the sequence of filling the arrays of microdots forming the halftone cell 13 is regular but is designed to achieve the same effect as a random distribution of spots, i.e. regularly growing clusters are not formed. Such a sequence of filling the halftone dot 15 is shown in FIG. 4B which represents an 8×4 cell 13 having 32 microdots. The numbers refer to the filling sequence of the halftone cell 13. When no element of the 8×4 array is black, the halftone cell 13 is purely white. When all 32 elements of the halftone cell 13 are black, the result is purely black. The intermediate tones are produced by making the relevant number of elements black. There is no growth of regularly sized dots with increasing grey tone value. Instead, the clusters of spots remain small and separated from each other and their number rather than their size increases as the grey tone value increases. In mixed mode screening techniques such as disclosed in EP-A-0 740 457, the halftone dot size may be fixed for low densities and the mean distance between halftone dots may be variable to increase the density or grey tone value, whereas the dot size may be increased to further increase the grey tone value.

The FM screening methods are more sensitive to the Image Spot Size Deviation Variables (ISSDV) than the AM screening methods because a change in laser intensity in the imagesetter 10 has less effect on the close clusters of spots in the halftone dots of AM screening. Where a considerable number of spots are clustered together, the overlapping created by oversize spots in the middle of the cluster does not change the outer contours of the cluster nor the grey tone value. Only the spots on the periphery contribute to the increase in size of the cluster and therefore to the change in image density. If the dimensions of a spot were to change in size by 20%, the area of the spot changes by 44% (1.2×1.2=1.44). The change in diameter of a cluster of 20×20 spots would only be caused by the peripheral spots. The change in diameter would therefore be the same quantitative amount as for a single spot. The resulting change in area would only be 2% (20.2×20.2=408.4=1.02×original area). Hence, a 20×20 cluster of spots is substantially more insensitive to the Image Spot Size Deviation Variables (ISSDV). The area of a 4×4 cluster would change by 10% (4.2×4.2=17.64=1.1×original area). A 4×4 cluster is therefore more sensitive to the Image Spot Size Deviation Variables (ISSDV) than a 20×20 cluster.

FM screening preferentially only uses individual fixed size spots or small clusters of spots, so that a change in spot size on the imaged medium 11 has a considerable effect on the grey tone value of the final image. It is particularly important for FM screening methods to be able to set up the imager 10 correctly and also to monitor the quality of imager, photographic film or printing plate performance regularly, accurately and easily. The visual control strip according to the present invention achieves this aim.

Figure 5A:
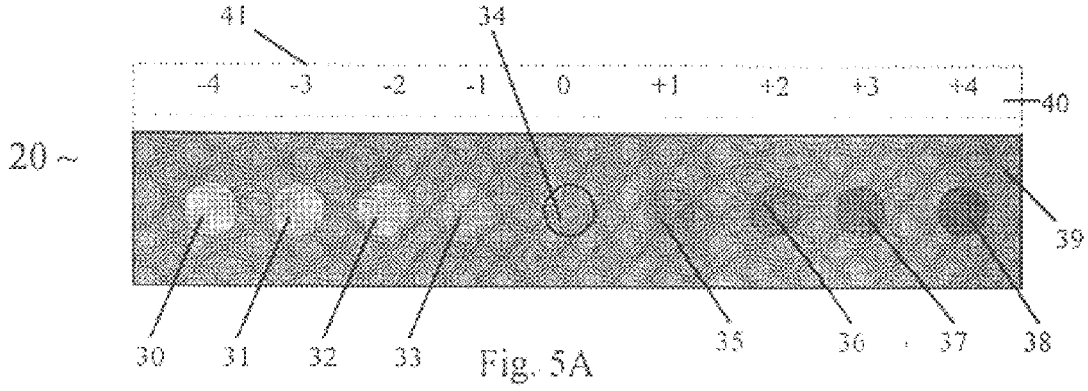
FIGS. 5A to 5C show visual control strips after imaging on an imageable medium in accordance with the present invention, having different dot percentages for the ISSDV sensitive portion 39.
Figure 5B:
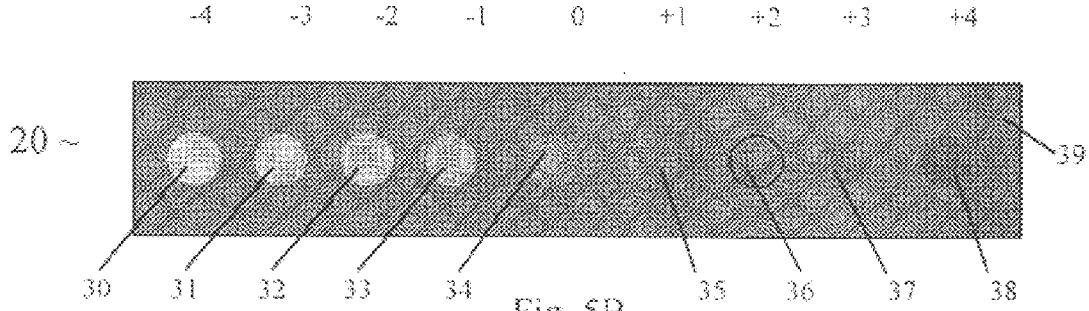
Figure 5C:
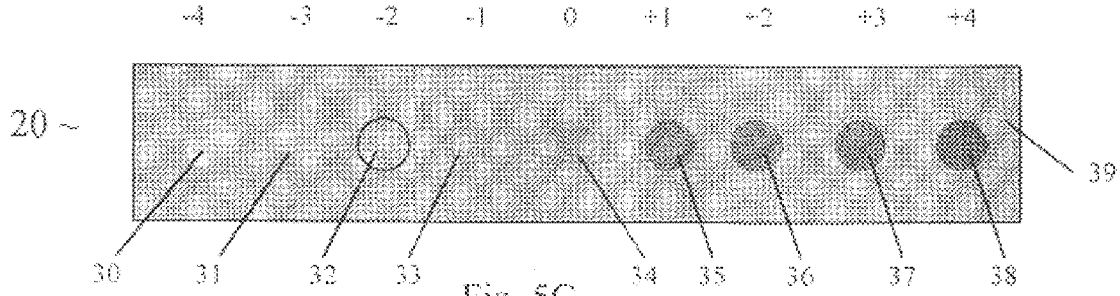
Figure 8A:
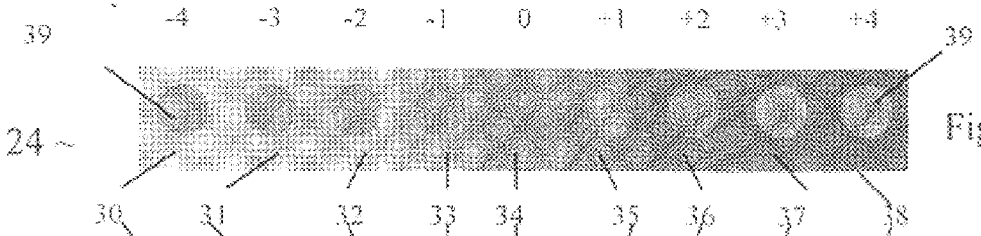
FIGS. 8A to 8C show further visual control strips in accordance with the present invention.
Figure 8B:
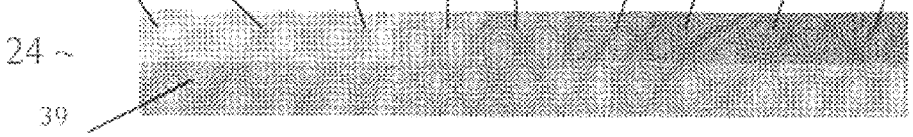
Figure 8C:
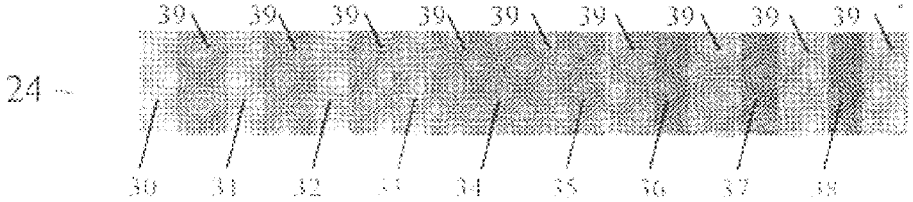
Figure 7:
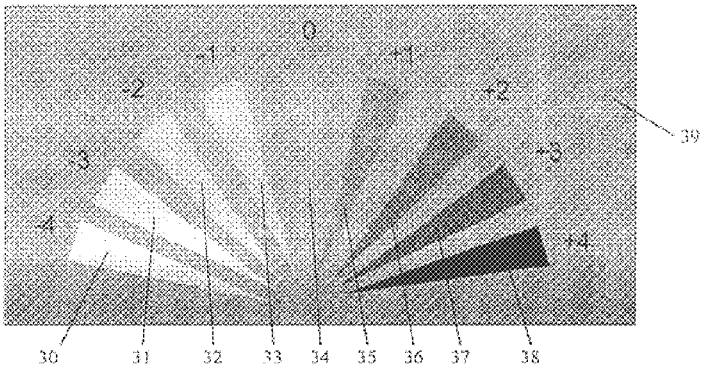
FIG. 7 shows a further visual control strip in accordance with the present invention.
Figure 6:
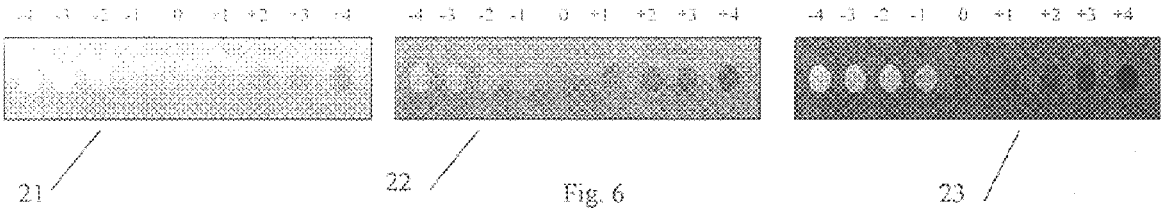
FIG. 6 shows a set of visual control strips in accordance with the present invention.

A visual control strip 20 in accordance with the present invention is shown schematically in FIGS. 5A to 5C at different exposure levels when the visual control strip has been formed on an imaged medium 11. The strip 20 may be imaged onto a photographic printing plate or photographic film 11 by imager 10. Alternatively, strip 20 may be a strip recorded on photographic film which is imaged onto the medium 11 by contact exposure as is conventional in the manufacture of lithographic plates. The visual control strip 20 comprises a plurality of control fields 30 to 38 relatively insensitive to the Image Spot Size Deviation Variables (ISSDV) and a background field 39 relatively sensitive to the Image Spot Size Deviation Variables (ISSDV). Preferably, an alpha-numerical field 40 is also provided above or below the control fields 30 to 39. The ISSDV insensitive control fields 30–38 are arranged in such a way as to ease the visual comparison with the ISSDV sensitive background field 39. That advantage is achieved by improving the contact between the sensitive and the insensitive zones. One embodiment is shown in FIGS. 5A, 5B and 5C. There, the insensitive fields 30–38 are completely surrounded by the sensitive field 39. In FIG. 6, the same configuration is used. In FIG. 7, the insensitive fields 30–38 have a shape of a circle segment, whereas the sensitive field 39 is surrounding completely the insensitive fields. According to FIG. 8A, the circular sensitive fields 39 are surrounded by the insensitive fields, having stepped dot percentage values. FIG. 8B is very similar to the prior art control strip according to DE-A-19 507 665. FIG. 8C shows also a preferred arrangement, where the sensitive fields 39 are pair-wise enclosed by insensitive fields 30–38. The outer dimensions of the digital control strip 20 (defined by the bounding box, 41) are typically 12 mm or more preferably 10 mm or less in width. Each ISSDV insensitive control field 30 to 38 has a different grey tone value. The grey tone value of each control field 30 to 38 is also substantially independent of, or at least only marginally dependent upon the Image Spot Size Deviation Variables within wide limits. This independence can be achieved by correct choice of the elements which make up fields 30 to 38, e.g. they may be certain types of coarse checkerboard patterns or patterns created with an AM screening method of a low screen ruling.

On the other hand, the background 39 is provided by a field whose grey tone value is more sensitive to the Image Spot Size Deviation Variables (ISSDV). For example, ISSDV sensitive background field 39 may be a field created using a stochastic or frequency modulated screening method built up by small halftone dots, each halftone dot formed by one spot or a few spots. Alternatively, field 39 may include a fine checkerboard pattern. In accordance with the present invention the ISSDV sensitivity of the background 39 is normally (default value) set to at least the ISSDV sensitivity of the screening method used for the useful image to be placed on the medium 11. Thus, if the useful image is to be produced in Agfa CristalRaster™ technology, the sensitive field 39 would be preferably a 50% raster field of this type. On the other hand if the Agfa Balanced Screening method is used the default sensitive field 39 could be, for example, a 4×4 checkerboard field or a 50% raster field of the ABS type having the same screen ruling as the screen ruling used for the useful image.

The skilled person will appreciate that the ratio of sensitivities of the ISSDV insensitive control fields 30–38 and the ISSDV sensitive background field 39 is relevant to the correct functioning of the visual control strip 20 in accordance with the present invention. Absolute values of sensitivity are less relevant provided the sensitive and insensitive fields behave in a consistent fashion with respect to the Image Spot Size Deviation Variables. For small deviations in spot size, the change in area "A" of a spot is proportional to its perimeter "P" (see FIG. 2D). Hence, the ratio of sensitivities of the ISSDV insensitive field 35 and the ISSDV sensitive background 39 is given approximately by the ratio of:

the total perimeter of the elements or halftone dots (clustered spots) which make up a unit area (e.g. 1 $mm^2$ or within one halftone cell or one supercell) of an ISSDV insensitive control field such as 34;

and, the total perimeter of the elements or halftone dots (clustered spots) which make up a unit area (e.g. again 1 $mm^2$ or within one halftone cell or one supercell having the same size) of the ISSDV sensitive field such as background 39.

For example, if field 34 is designed to have a 50% dot percentage and includes a 4×4 spot checkerboard pattern and field 39 has single (1×1) spots, the perimeter of the spots in background 39 is four times larger than the perimeter of the 4×4 checkerboard pattern, as measured in the same area. Hence, the ratio of sensitivities is 0.25. In accordance with the present invention this ratio of sensitivity is preferably less than 0.35, more preferably less than 0.25 and most preferably less than 0.125. High sensitive fields may be formed by:

a dot-size modulated periodic halftone screen having a high line ruling;

a frequency modulated halftone screen using small sized halftone dots, composed of one or only a few spots or microdots;

a checkerboard pattern having small square patterns, each square pattern composed of 1, 2×2, 3×3, etc. spots or halftone dots; or, a line pattern, wherein the thickness of each line corresponds to one or a few microdots.

Low sensitivity fields may be formed by:

a dot-size modulated periodic halftone screen having a low line ruling;

a frequency modulated halftone screen using large sized halftone dots, composed of many spots or microdots a checkerboard pattern having big square patterns, each square pattern composed of e.g. 16×16 spots or halftone dots; or, a line pattern, wherein the thickness of each line corresponds to many microdots.

In low sensitivity fields, the size of the elements much be such that the eye still integrates the microdensities to uniform densities.

The ISSDV insensitive control fields 30 to 38 may have regularly spaced dot percentages or grey tone values, e.g. 30%, 35%, 40%, 45%, 50%, 55%, 60%, 65%, 70% which are associated with the numerical reference values of −4 to +4 in the alpha-numerical field 40. Field 39 may be designed to have a target grey tone value of 50%. Thus, as shown in FIG. 5A, under ideal conditions, with the imager 10 perfectly calibrated to the film 11, the field 34 annotated with "101" is indistinguishable from the background 39. FIGS. 5B and 5C show the situation where the medium exposure is not properly set. In FIG. 5B the background 39 has been produced so much darker than a tone value of 50%, that the field 36, annotated with "+2", is indistinguishable from the background 39 rather than the field 34 annotated with "0". In FIG. 5C, the background field 39 is lighter than a grey tone value of 50% so that the field 32, annotated with "−2", is indistinguishable from the background 39. To increase the accuracy of the control strip 20, more ISSDV insensitive control fields 30 to 38 may be provided with a corresponding smaller grey tone value difference between neighbouring fields.

In a preferred embodiment the grey tone values of the ISSDV insensitive control fields 30 to 38 are not simply a linear or regular scale of grey tones but rather they are linked to the differentiated well-defined sizes of the actual spots on the imaged medium after development which are responsible for the generation of the different grey tone values. For instance, the numerical values of the alpha-numerical field 40 may be directly related to the effect of a specific change in size of the spot. For example field 32, which has the numerical value "−2", may have a grey tone value equal to the grey tone value produced on field 39 when the actual spot size on the imaged medium after development is 2 micron smaller than the spot size required to produce the grey tone of the field 34 annotated with the numeral "0". Similarly, "+4", which corresponds to the ISSDV insensitive field 38, may indicate that field 38 has a grey tone value equal to the grey tone value produced on field 39 when the spot size on the medium after development is 4 micron larger than the spot required to produce the grey tone value of the field 34 annotated with the numeral "0". By linking the numerical field 40 to the effect of the spot size variation, the adjustments to the imager 10 may be carried out more easily. In a preferred embodiment, inputs to the imager 10 of the number in field 40 corresponding to the control field 30–38 which is indistinguishable over the background field 39 may be processed by suitable logic circuits in imager 10 and result in an automated exposure adjustment.

The present invention is not limited to a grey tone target value of 50% for the background field 39, but other values may be chosen. In particular it is advantageous to use a sequence of strips 21 to 23 as shown in FIGS. 6, wherein the background field 39 of each strip 21–23 may have a different grey tone target value, e.g. strip 21 with 25%, strip 22 with 50%, and strip 23 with 75%. The ISSDV insensitive fields 30 to 38 are determined for each strip 21 to 23 so that each field 34 of the relevant strip 21–23 annotated with the numeral "0" has the respective grey tone target value, i.e. for strip 21, the respective field 34 annotated with the numeral "0" has a grey tone value of 25%; for strip 22, it has the value 50% and 75% for strip 23. This set of strips may allow the user to adjust and control more easily the exposure of imager 10 for non-linearly behaving systems, e.g. when recording with FM screening methods on photographic film. It may also allow for selecting other exposure criteria. For example, the exposure setting may be chosen which results in a visual match of field 34 annotated with the numeral "0" with the background field 39 on the strip 21 (target=25%) instead of on the strip 22 (target=50%).

In accordance with the present invention the ISSDV insensitive fields 30–38 and the sensitive field 39 are not limited to a linear array as shown in FIGS. 5 and 6. The fields may be arranged in any suitable two dimensional array. For instance, as shown FIG. 7, the ISSDV insensitive fields 30 to 38 may be arranged radially on an ISSDV sensitive background 39. Due to the familiarity among operators with analogue clock faces, such an arrangement can be used easily when formed into twelve equally spaced radial fields around 360° thus forming a "grey tone clock". Such a clock may have particularly small dimensions, e.g. the dimension of a small wrist watch such as 15 mm×15 mm. In such cases the numerical field 40 can be dispensed with or left away as the operator can read the "hours" 1 to 12 of the "clock" without numbers to help. The operator does not have to be capable to read the—often very small—arabic figures of the "hours".

The present invention is not limited to foreground fields 30 to 38 (FIG. 5A–5C) being the ISSDV insensitive fields. A further embodiment of the present invention is shown in FIG. 8A. Control strip 24 has a series of background fields 30 to 38 which have differing grey tone values, the pattern of each field 30–38 being substantially insensitive to the Image Spot Size Deviation Variables (ISSDV). Fields 39 which are sensitive to the Image Spot Size Deviation Variables are each located as a foreground field in one of the background fields 30 to 38. Each field 39 has a target grey tone value as described previously, e.g. 25%, 50% or 75% or similar. Alternatively, the ISSDV sensitive fields 30 to 38 and insensitive fields 39, are arranged one above the other as shown in FIG. 8B or alternating with each other as shown in FIG. 8C. In all the embodiments of the present invention the insensitive fields may take discrete (as shown in FIG. 8A, 8B and 8C) or continuously varying values.

The ISSDV sensitive field 39 (FIGS. 5 to 8) may be a checkerboard field, a pixel line field, or a raster field. The ISSDV insensitive fields 30–38 of the control strip 20 in accordance with the present invention may also each be a checkerboard field, a pixel line field, or a raster field, however, it is preferred if the raster field is not produced with an FM screening method having small halftone dots made up of one or only a few spots.

These three basic types of field in accordance with the present invention are shown in FIGS. 9 to 11. FIG. 9 shows a checkerboard, FIGS. 10A and B show pixel line fields, and FIGS. 11A and B show raster fields. Each of these fields includes one or more microdots. Within the fields dots, lines or fill are made up of an array of microdots. Each dot, line or fill constitutes an element. A plurality of elements makes a pattern. The elements may make up a pattern with a repetitive pattern cell which is tiled in order to fill up the area of the relevant control field 30–39. Alternatively, the control field 30–39 may include a series of lines or larger dots arranged in a predetermined pattern. One larger dot preferably comprises an integer number of microdots or spots.

Where the visual control strip 20–24 in accordance with the present invention is a digital control strip, it is preferably scalable. Scalability refers to the ability of the digital control strip to be transformed, i.e. resized to a different physical size, e.g. smaller or larger in one or two dimensions. According to the present invention, the strip is designed such that the integrity of the pattern within the fields is maintained. This means that scaling has no influence on the number of spots in an element of a pattern, nor on the relative location of the spots. Thus, when the outer dimensions of a field are altered differently in two orthogonal directions, the field is deformed but the elements within the field are not deformed. The undeformed elements fill the deformed field—if the field has become smaller, the number of elements in the field reduces. This property of the digital strip in accordance with the present invention may be achieved by defining the elements of a field in device space and the size of the fields themselves in user space. Device space is the internal co-ordinate system used by the raster imaging device 10 for scan conversion of the raster data file 9 and is usually expressed or "measured" in "pixel" units. User space is the internal co-ordinate system used to create the output file 6 in the device independent language such as PostScript™ and is usually expressed in metric units such as 1/72 of an inch (see AdobeRef, page 151) or millimeter. In order to convert the output file 6 to the raster data file 9, a current transform matrix (CTM) may be used (see AdobeRef, 4.3.2 Transformations, pages 152–154). This matrix converts the data in the output file 6 into data in raster data file 9 taking into account any difference in resolution between the co-ordinate systems of the user space (the device independent language) and the device space (raster imaging device 10). Thus, a distance of X units in the user space defined in output file 6 is converted by the CTM into the appropriate number of pixels Y in the device space which result in the same distance in device space as is represented by X units in the user space. Hence, by use of CTM the distance produced by the imaging device 10 is independent of the resolution of the imaging device 10.

On the other hand, data in output file 6 which is defined in device space is left untouched by the CTM. Thus X distance units of device space defined in output file 6 result in X distance units in device space. The actual size, in metric units, of elements defined in the device space is device dependent—the size depends on the number of dpi (microdots per inch) of the imaging device 10. For instance, the device space distance X printed by a 300 dpi printer would 10 times greater than by a 3000 dpi printer. In general, specifying data in device space is discouraged as the appearance of the data is device dependent and may seem to be deformed relative to user space.

Further explanations of the terms such as user space, device space, pattern, pattern cell, tiling, fill, CTM, scan conversion may be found in AdobeRef which has already been incorporated herein by reference.

The microdot spacing and the element spacing of a control field 30–39 is preferentially defined in device space, whereas the dimensions of a control field in accordance with the present invention may be defined in user space. Control fields 30–39 are preferably scalable and their size may be defined by the user. Depending on its size, a control field 30–39 is filled up with as many elements as required, the elements being clipped at the boundaries of the control field. As the pattern elements are defined in device space, their actual size on the imaged substrate is dependent on the resolution of the imaging device. On the other hand the size of the field itself is set by the user.

A control field 30–39 according to the present invention may be generated in PostScript™ in the following manner with reference to FIGS. 10A and B:

```
<<
  /PaintType 2
  /PatternType 1
  /TilingType 2
  /Bbox[0 0 8 1]
  /XStep X_StepL
  /Ystep 1
  /PaintProc {
      8 1 true [1 0 0 1 0 0]
     {<80>}
      imagemask
  }
>>
matrix
makepattern
/OnePixelLinesVer exch def
```

This program listing fragment defines a pattern "OnePixelLinesVer" which is 8×1 pixels in a matrix of 8×8 pixels in device space. The pattern consists of a vertical line 47 (FIG. 10A or B) having a thickness of one microdot or pixel in the device space. The pattern is defined in an 8×8 matrix so that the line width may be amended to be up to 8 pixels in thickness in other fields. The repetition distance between two matrices, X_StepL, is defined in user space (not listed above) so this repetition distance is output device independent. The complete field is defined in user space:

0 0 X_fieldY$_{_field}$ 1.0/PixelLinesVer setpattern rectfill which generates a field of the required size which is filled by the pattern OnePixelLinesVer and is clipped at the boundaries of the field. Note also that the field is scalable in user space without altering or deforming the pattern of the element OnePixelLinesVer which is defined in device space. As shown in FIGS. 10A and B, the pixel line 47 may be a black line surrounded by white or vice-versa.

If pixel line fields are used, their performance may depend upon whether the lines lie parallel or perpendicular to the fast scan direction in the imager 10. To provide an indication of differences between the fast scan and cross-scan directions it is advantageous to use pixel lines which are orthogonal to each other, i.e. to have part of the control field with vertical lines and part with horizontal lines.

To create a checkerboard pattern, the above script may be amended to create alternating, X×X black and white squares in the 8×8 matrix 46 (FIG. 9). In this case the distance X_StepL is not defined. Instead, the 8×8 matrix is specified as the pattern cell and tiled within the field 30–39 by means of the rectfill command. This generates a pattern of black and white, for example 4×4 device pixel squares whose size is device dependent and non-scalable (see FIG. 9). The field (30–39) dimensions are specified in user space using scalable dimensions.

FIG. 9 shows a checkerboard field in accordance with the present invention. The checkerboard may be made up of a repetitive element or pattern cell 46 of X×X black device pixels combined with Y×Y white or transparent pixels. If X=Y the result is a theoretical dot percentage of 50% and should produce a grey tone value of 50%.

FIGS. 11A and B show schematic representations of a raster field. Each halftone cell contains one halftone dot 48. This results in a regular array of dots 48 in lines at the screening angle. The grey tone value is determined by the size of the halftone dot 48. As shown in FIG. 11B, a raster field may be formed by white dots on a black background.

The ISSDV sensitive fields 39 may be generated using uniform grey tone fields having stochastic or FM screening methods such as the Agfa CristalRaster™ technology provided by Agfa-Gevaert, N.V., Mortsel, Belgium or other types of ISSDV sensitive screening methods such as the Bayer halftone screening method mentioned above. Alternatively, checkerboard, pixel line or raster fields may be used which are characterised by a relatively large perimeter "P" per unit surface "A" (see FIG. 2D).

To assist in adjusting the imager 10 a correspondence table may be produced as shown in Table 1 below. The values have been calculated for an output device 10 with a resolution of 2,400 dpi and a sensitive control field 39 having a checkerboard pattern of 4×4. The dot gain "x" in Table 1 refers to the increase (+x) or decrease (−x) in the radius of the spot over the specified value for the field "0" of the control strip 20 of FIG. 5A, i.e for a theoretical 50% dot percentage.

A 50% dot percentage, according to table 1 below, is realised by defining a square supercell having two square halftone dots. The length and width or size of the supercell is 8 microdots. The size of each halftone dot is 4 microdots. The first microdot is located in the top left corner of the supercell. The second microdot is located in the bottom right corner of the supercell. As such, both microdots touch each other at a corner point situated right in the middle of the supercell.

We suppose that in the ideal situation each spot fills exactly one microdot. At a resolution of 2,400 microdots per inch (2,400 dpi), the size s of the ideally square spot is the same as the size of a microdot, i.e. 25.4 mm/2,400=10.58 $\mu$m. The size of an ideally square halftone dot in a checkerboard pattern formed by 4×4 ideal spots or halftone dots is 4*10.58 $\mu$m=42.33 $\mu$m. This size corresponds with a halftone dot having no dot gain nor dot loss, or a dot gain of 0 $\mu$m, as shown in the middle line of Table 1 below. The area of one such halftone dot is $(42.33\ \mu m)^2$=1792.11 $\mu m^2$. Two such square halftone dots are placed in a supercell, composed of 8×8 microdots. The size of the supercell is 8*10.58 $\mu$m=84.66 $\mu$m. The area A of such a supercell is A=(84.66

$\mu m)^2$=7168.44 $\mu$m. The dot percentage of two such halftone dots placed in one such supercell is:

100%*2*1792.11/A=50.00%. This percentage is also found in Table 1 below for a dot gain of 0 $\mu$m.

If the dot gain is −1 $\mu$m, which means in fact a dot loss of 1 $\mu$m, this means that each side of the ideal square halftone dot shifts by 1 $\mu$m to the centre of the halftone dot. This means that the size of such a non-ideal halftone dot having a dot loss of 1 $\mu$m is effectively 42.33 $\mu$m−2 $\mu$m=40.33 $\mu$m. The area of both square halftone dots in the supercell is then (40.33 $\mu m)^2$=1626.77 $m^2$. The dot percentage is then reduced to 100%*2*1626.77/A=45.39%. This percentage is shown also in Table 1 below for a dot gain of −1 $\mu$m. In the same way, the theoretical dot percentages associated with other dot loss values may be computed, according to the equation:

$$y=100\%*2*(d_0+2x)^2/A$$

In the above equation, y is the theoretical grey tone value in percentage;

$d_0$ is the size of the ideal halftone dot, expressed in $\mu$m;

x is the dot gain of each individual spot and thus the shift of each side of the ideal halftone dot towards the centre of the halftone dot for negative values of x; and, A is the area of the halftone cell or supercell comprising the two halftone dots.

The above equation is not valid for positive values of x or dot growth. It is however clear to the man skilled in the art that a dot growth of a black halftone dot may be assessed by the thus caused dot loss of the neighbouring white halftone dot, for which the equation holds. This explains why the dot percentage found for a dot gain of +1 $\mu$m, i.e. 54.61% is complementary to the dot percentage found for a dot loss of 1 $\mu$m, i.e. 45.39%.

TABLE 1

| dot gain x [$\mu$m] | halftone dot size for checkerboard [$\mu$m] | theoretical dot percentage y [%] |
|---|---|---|
| −5 | 32.33 | 29.17 |
| −4 | 34.33 | 32.89 |
| −3 | 36.33 | 36.83 |
| −2 | 38.33 | 41.00 |
| −1 | 40.33 | 45.39 |
| 0 | 42.33 | 50.00 |
| +1 | 44.33 | 54.61 |
| +2 | 46.33 | 59.00 |
| +3 | 48.33 | 63.17 |
| +4 | 50.33 | 67.11 |
| +5 | 52.33 | 70.83 |

Table 1 may be used when the ISSDV sensitive field has a 4×4 checkerboard pattern. The dot percentages of the ISSDV insensitive fields are preferably set to the grey tone values corresponding to the theoretical values of the "y" column caused by the dot gain of −5 to +5 micron of the basic spot. If the visual control strip shows correspondence at "−2" (corresponding to −2 $\mu$m dot gain of the basic spot) between the ISSDV insensitive and sensitive fields, then the image produced by the imager 10 at 50% dot percentage has an effective grey tone value of about 41% instead of 50%. From this converted value of achieved grey tone value, the necessary adjustments to the imager 10 can be made. Preferably the screen ruling of the sensitive fields is the same as the screen ruling of the useful image data. The screen ruling of the insensitive fields is usually smaller.

Alternatively, table 1 may be used to control the degree of over- or under-exposure. Thus, if under-exposure should be used deliberately, the degree of under exposure may be selected form the table and the imager 10 set up to accordingly.

Figure 12:
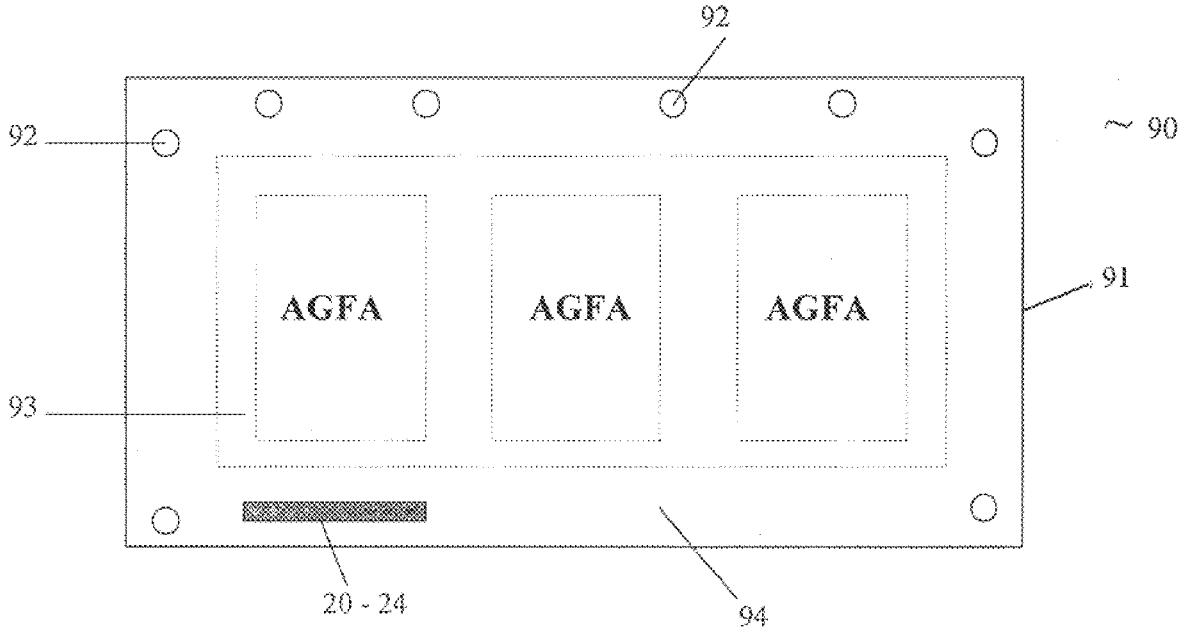
FIG. 12 shows a schematic top-view of an offset printing plate in accordance with the present invention.

The visual control strips 20–24 (FIGS. 5, 6, 7, 8) in accordance with the present invention may be used in the following way. Where the visual control strip is a digital control strip, the digital representation of the strip 20–24 is incorporated into a digital representation of a normal page in the computer 2 as, for instance, an EPS file. This file may be imaged directly onto a printing plate. The control strip is preferably located in an image-wise functionally irrelevant part of the page layout. As an example, when used to check the quality of the imager used to image an offset printing plate without mounting the plate on the press and producing a proof print, the control strip may be located in an area of the plate which is outside the zone to be inked. An imaged offset printing plate 90 is shown schematically in FIG. 12 and comprises a substrate 91, e.g. aluminium or polyester on which an image has been formed after imaging in a raster imaging device and possibly a subsequent developing step. Printing press location or registration holes 92 may be provided. Within the confines of the location holes 92, an inkable area 93 is defined. It is within this area 93 that the normal pages or graphic images have been imaged onto the plate 90. There are many arrangements for securing the printing plate 90 to the plate cylinder, as e.g. described in U.S. Pat. No. 4,643,063 as but one example (plate securing on web offset presses). When mounted on the offset printing press, the inkable area 93 will be subjected to the ink rollers. Outside the inkable area 93, there is a perimeter area 94 which is not inked and serves no image-wise purpose. This area has the mechanical function of locating and securing the plate to the press but has no function with respect to the reproduction of the image itself, i.e. no image-wise functionality. It is in this area 94 that one or more of the control strips 20–24 in accordance with the present invention may preferably be placed. It is particularly preferred if the control strip 20–24 of the present invention, is placed in the plate portion of zone 94 which is received in the plate locking or clamping device of the printing plate cylinder.

As the control strip 20–24 in accordance with the present invention is preferably scalable, it can be fitted to the available space in ink-free zone 94. Because the field elements are preferably not scalable, they remain suitable for quality control purposes independently of the size of the fields, provided these are each greater than a minimum size of preferably 2 mm.

Further, in a preferred embodiment, the type of field, e.g. checkerboard, pixel line, raster field, the type of screening method and the screen angle are set for both the ISSDV sensitive and insensitive fields as well as the target value(s) of the sensitive field(s) in accordance with default values. The operator can alternatively select any of these variables from a menu to tailor the visual control strip 20–24 to the needs of a particular job.

Where the visual control strip 20–24 in accordance with the present invention is an analogue strip for use in photomechanical screening or contact illumination, the strip may be used in the following way. The visual control strip 20–24 comprises a piece of film which can be included in the page layout film. Again this piece of film including the visual control strip 20–24 is preferably located on a part of the layout film that lies outside the useful printable and inkable area of the printing plate produced from the layout film.

Further, the visual control strip 20–25 in accordance with the present invention has been described with reference to a plurality of ISSDV relatively insensitive fields and a single ISSDV relatively sensitive field but the invention is not limited thereto. The visual control strip in accordance with the present invention also includes a single ISSDV relatively insensitive field 39 and a plurality of ISSDV relatively sensitive fields 30 to 38 (the visual control strip would still appear as shown in FIGS. 5 to 8 but the sensitive fields would be insensitive and vice-versa). The relative sensitive fields 30 to 38 could each have differing grey tone value target values, e.g. 30%, 35%, 40%, 45%, 50%, 55%, 60%, 65%, 70% ; and the insensitive field could have a grey tone value of 25% or 50% or 75%.

The simplest form of visual control strip 20–25 in accordance with the present invention is a single ISSDV relative insensitive field located adjacent to, or surrounded by a single ISSDV relative sensitive field or vice-versa. Such a visual control strip can be used to identify when the predetermined grey tone value of the ISSDV relative insensitive field is the same as the target grey tone value of the ISSDV relative sensitive field.

Figure 13:
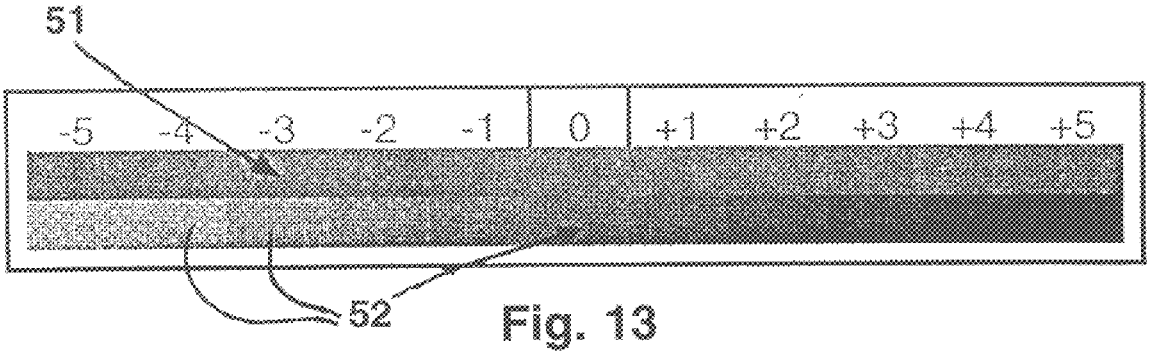
FIG. 13 shows a control strip in which insensitive fields are adjacent to each other and to a sensitive field.

FIG. 13 shows a control strip in which a single ISSDV relative sensitive field 51 is located adjacent to a plurality of ISSDV relative insensitive fields 52. The sensitive field 51 represents a 50% grey tint and is screened according to the Agfa CristalRaster technology, a type of frequency modulated halftoning. In reality, the size of a frequency modulated halftone dot, according to the test as described herein below in conjunction with FIG. 13, is 21 $\mu$m. The insensitive fields 52 have a dot percentage of 25%, 30%, 35%, 40%, 45%, 50%, 55%, 60%, 65%, 70% and 75%. These are screened according to the Agfa Balanced Screening (ABS) technology, as disclosed in U.S. Pat. No. 5,155,599. The line ruling of the ABS screen is 120 lpi (lines per inch). Due to the shorter outline with respect to the area of each halftone dot in the ABS screening at 120 lpi, the fields 52 are less sensitive to overexposure and underexposure.

Figure 14:
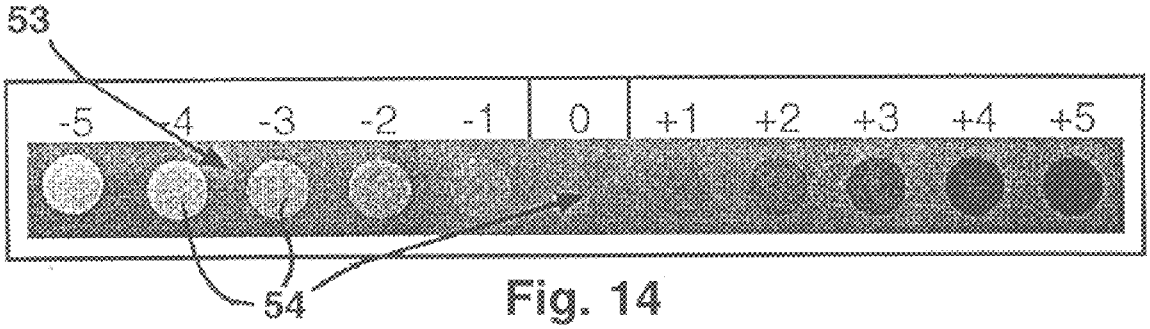
FIG. 14 shows a control strip in which insensitive fields are not adjacent to each other, but completely embedded in a sensitive field.

FIG. 14 shows another test strip and shows a sensitive field 53, having the same structure as the sensitive field 51; and insensitive fields 54, having the same structure and dot percentages as the insensitive fields 52. However, according to FIG. 14, the insensitive fields 54 are completely and separately embedded in the sensitive field 53, whereas in FIG. 13 the insensitive fields 52 are arranged adjacent to each other and are also placed adjacent, i.e. underneath, to the sensitive field 51. A series of exposures were accomplished with both control strips according to FIG. 13 and FIG. 14. Log H of subsequent exposures increased by 0.05 from exposure to exposure. Two types of offset printing plates were exposed:

1. Lithostar LAP-0 0.30 mm, digitally exposed by a Stinger system at 2400 dpi (dots per inch)
2. Setprint SET-HN-J 0.20 mm, digitally exposed by an Agfa SelectSet Avantra 25 system at 2400 dpi.

The exposed offset plates were offered to five test persons for identification of the control strips having a correct exposure. All five test persons preferred this evaluation on the control strip according to FIG. 14, where the insensitive fields 54 are completely surrounded by the sensitive field 53. Evaluation of the correct exposure on the strip according to FIG. 14 is more convenient, fast and accurate than evaluation on the strip according to FIG. 13. The circular regions 54 shown in FIG. 14 tend to disappear in the background 53 when there is a correspondence of the circular region 54 with the background 53. In FIG. 13, a border line between fields 51 and 52 is perceived, even where the insensitive field 52 corresponds to the sensitive field 51, due to optical illusion. Accordingly, evaluation of the correct exposure of a control strip according to FIG. 14 is more consistent and less subjective than evaluation of the exposure of a control strip according to FIG. 13.

We claim:

1. A visual control strip for imageable media such as a printing plate, photographic film or a printing substrate, said visual control strip to be applied to the imageable medium, comprising:

at least one first control field relatively insensitive to Image Spot Size Deviation Variables (ISSDV); and, having at least a first portion with a first dot percentage value;

and, at least one second control field relatively sensitive to said Image Spot Size Deviation Variables (ISSDV);

located immediately adjacent said first ISSDV insensitive control field; and, having at least a second portion with a second dot percentage value, said second dot percentage value being substantially equal to said first dot percentage value;

wherein at least one of said first or said second field is completely surrounded by a field of different ISSDV sensitivity.

2. A visual control strip according to claim 1, comprising:

a plurality of said first insensitive fields having different dot percentage values; and, one of said second sensitive field, having one uniform dot percentage value.

3. A visual control strip according claim 1, wherein said first insensitive and/or second sensitive control fields include any one of raster, pixel line or checkerboard fields.

4. A visual control strip according claim 1, wherein the ISSDV sensitivity of said first insensitive control field is preferably less than one third, more preferably less than one quarter and most preferably less than one eighth of the ISSDV sensitivity of said second sensitive control field.

5. A visual control strip according to claim 1, wherein said second sensitive control field surrounds said first insensitive control field.

6. A visual control strip according to claim 2, wherein the dot percentage values of the plurality of first insensitive control fields are related to a regular ascending sequence of spot sizes for said second sensitive control field, the sequence having preferably a constant spot size interval between spot sizes.

7. A visual control strip according to claim 1, wherein said visual control strip is a digital control strip and each first or second control field includes at least one element, wherein each said element is not scalable and each said control field is scalable independently of said elements.

8. A visual control strip according to claim 7, wherein the representation of the digital control strip is stored in an output device independent language;

said elements are defined in output device space; and, said fields are defined in user space.

9. A plurality of visual control strips in accordance with claim 1, wherein:

said second sensitive control field of at least one visual control strip has a second dot percentage value different from the second dot percentage value of any other second control field of any other visual control strip.

10. An imaged medium including at least one visual control strip according to claim 1, preferably located in an image-wise irrelevant portion of the imaged medium.

11. An imaged medium according to claim 10, wherein the imaged medium is a printing plate for a printing press and the image-wise irrelevant portion is locatable in the locking device of the printing press.

12. A method, comprising the steps of:

applying a visual control strip to an imageable media such as a printing plate, photographic film or a printing substrate, said visual control strip including:

a) at least one first control field relatively insensitive to Image Spot Size Deviation Variables (ISSDV), and having at least a first portion with a first dot percentage value; and b) at least one second control field relatively sensitive to said Image Spot Size Deviation Variables (ISSDV), located immediately adjacent said first ISSDV insensitive control field, and having at least a second portion with a second dot percentage value, said second dot percentage value being substantially equal to said first dot percentage value, wherein at least one of said first or said second field is completely surrounded by a field of different ISSDV sensitivity; and assessing imaging quality of an imaging system using the visual control strip.

13. A method according to claim 12, wherein the imaging system is:

a system for producing imaged printing plates; or, a computer-to-plate system.

14. Apparatus for generating a visual control strip on imageable media such as a printing plate, photographic film or a printing substrate, said apparatus comprising:

means for generating at least one first control field:

relatively insensitive to Image Spot Size Deviation Variables (ISSDV); and, having at least a first portion with a first dot percentage value;

and, means for generating at least one second control field:

relatively sensitive to said Image Spot Size Deviation Variables (ISSDV);

located immediately adjacent said first ISSDV insensitive control field; and, having at least a second portion with a second dot percentage value, said second dot percentage value being substantially equal to said first dot percentage value;

the apparatus further comprising means for generating at least one of said first or said second field completely surrounded by a field of different ISSDV sensitivity.

15. A visual control strip for imageable media such as a printing plate, photographic film or a printing substrate, said visual control strip to be applied to the imageable medium, comprising:

at least one first control field relatively insensitive to Image Spot Size Deviation Variables (ISSDV); and, having at least a first portion with a first dot percentage value;

and, at least one second control field relatively sensitive to said Image Spot Size Deviation Variables (ISSDV);

located immediately adjacent said first ISSDV insensitive control field; and, having at least a second portion with a second dot percentage value, said second dot percentage value being substantially equal to said first dot percentage value;

wherein at least one field, selected from said first and said second field, is directly adjacent on at least two sides to a field of different ISSDV sensitivity.

16. A visual control strip according to claim 15, comprising:

a plurality of said first insensitive fields having different dot percentage values; and one of said second sensitive fields, having one uniform dot percentage value.

17. A visual control strip according to claim 15, wherein said first insensitive and/or second sensitive control fields include any one of raster, pixel line or checkerboard fields.

18. A visual control strip according to claim 15, wherein the ISSDV sensitivity of said first insensitive control field is preferably less than one third, more preferably less than one quarter and most preferably less than one eighth of the ISSDV sensitivity of said second sensitive control field.

19. A visual control strip according to claim 15, wherein said second sensitive control field surrounds said first insensitive control field.

20. A visual control strip according to claim 16, wherein the dot percentage values of the plurality of first insensitive control fields are related to a regular ascending sequence of spot sizes for said second sensitive control field, the sequence having preferably a constant spot size interval between spot sizes.

21. A visual control strip according to claim 15, wherein said visual control strip is a digital control strip and each first or second control field includes at least one element, wherein each said element is not scalable and each said control field is scalable independently of said elements.

22. A visual control strip according to claim 21, wherein:

the representation of the digital control strip is stored in an output device independent language;

said elements are defined in output device space; and, said fields are defined in user space.

23. A plurality of visual control strips in accordance with claim 15 wherein:

said second sensitive control field of at least one visual control strip has a second dot percentage value different from the second dot percentage value of any other second control field of any other visual control strip.

24. An imaged medium including at least one visual control strip according to claim 15, preferably located in an image-wise irrelevant portion of the imaged medium.

25. An imaged medium according to claim 24, wherein the imaged medium is a printing plate for a printing press and the image-wise irrelevant portion is locatable in a locking device of the printing press.

26. Apparatus for generating a visual control strip on imageable media such as a printing plate, photographic film or a printing substrate, said apparatus comprising:

means for generating at least one first control field relatively insensitive to Image Spot Size Deviation Variables (ISSDV); and, having at least a first portion with a first dot percentage value;

means for generating at least one second control field relatively sensitive to said Image Spot Size Deviation Variables (ISSDV);

located immediately adjacent said first ISSDV insensitive control field; and, having at least a second portion with a second dot percentage value, said second dot percentage value being substantially equal to said first dot percentage value;

and means for generating a field selected from said first and said second field, said field being, on at least two sides, directly adjacent to a field of different ISSDV sensitivity.

* * * * *